US005231722A

United States Patent [19]

Shacklock et al.

[11] Patent Number: 5,231,722

[45] Date of Patent: Aug. 3, 1993

[54] WASHING MACHINE AND METHOD OF CONTROLLING THE SAME

[75] Inventors: Frank W. Shacklock; Murray Greenman, both of Auckland, New Zealand

[73] Assignee: Fisher & Paykel Limited, Auckland, New Zealand

[21] Appl. No.: 717,839

[22] Filed: Jun. 21, 1991

[30] Foreign Application Priority Data

Jun. 21, 1990 [NZ] New Zealand ..... 234172
Nov. 15, 1990 [NZ] New Zealand ..... 236097

[51] Int. Cl.[5] ..... D06F 33/02

[52] U.S. Cl. ..... 8/159; 68/12.22; 137/387; 137/606

[58] Field of Search ..... 68/207, 12.12, 12.22; 137/606, 387; 8/159

[56] References Cited

U.S. PATENT DOCUMENTS

| | | | |
|---|---|---|---|
| 2,442,886 | 6/1948 | Bowen | 68/12.22 X |
| 2,444,631 | 7/1948 | Chace | 68/12.22 X |
| 3,707,856 | 1/1973 | Niewyk et al. | 68/207 X |
| 4,267,711 | 5/1991 | Kolze | 68/207 X |
| 4,322,031 | 3/1982 | Gehlert | 68/12.22 X |
| 4,330,081 | 5/1982 | McMillan | 68/12.22 X |
| 4,406,401 | 9/1983 | Nettro | 68/12.22 X |
| 4,643,350 | 2/1987 | DeSchaaf et al. | 68/12.22 X |
| 4,978,058 | 12/1990 | Duncan et al. | 236/12.14 |

FOREIGN PATENT DOCUMENTS

| | | | |
|---|---|---|---|
| 3023355 | 1/1982 | Fed. Rep. of Germany | 68/12.22 |

OTHER PUBLICATIONS 118,167 Sep. 1984, EP (European Patent Application).

*Primary Examiner*—Frankie L. Stinson
*Attorney, Agent, or Firm*—Jacobson, Price, Holman & Stern

[57] ABSTRACT

The temperature or some other specific characteristic of a mixture of two liquids at different temperatures in a mixing chamber (14) is controlled by a microprocessor (8) which controls the supply of power to solenoid actuated valves (10 and 11) to control the quantities of the liquids admitted to the chamber (14) so that a desired temperature of the mixture is achieved using pulse width modulation control. The pulse width modulation control requires only one microprocessor timer and provides a substantially constant supply of power to one valve while varying the power supplied to the other valve to control flow through each valve and thus the temperature of the liquid mixture.

22 Claims, 6 Drawing Sheets

Cold Valve Duty Cycle (worst case)

Hot Valve Duty Cycle (worst case)

WASHING MACHINE AND METHOD OF CONTROLLING THE SAME

FIELD OF THE INVENTION

This invention relates to laundry machines and methods of controlling operations of laundry machines.

BRIEF SUMMARY OF THE INVENTION

It is an object of the, present invention to provide a laundry machine and a method of controlling operations thereof.

Accordingly in one aspect the invention consists in a method of controlling a flow control system comprising a first valve through which a first liquid is supplied and a second valve through which a second liquid is supplied, both said valves being solenoid actuated valves having a valve seat and a valve member controllably moveable from said valve seat by energisation of said solenoid by control means, and using a pulse width modulation system said method comprising the steps of beginning a modulation cycle having a predetermined modulation period by supplying energy to said solenoid of said first valve for a first predetermined period of time, supplying energy to said solenoid of said second valve for a second predetermined period of time which period begins after a predetermined elapsed period of time since said first period began, said elapsed period and said second period together being equal to said modulation period, and repeating said modulation cycle, whereby the energy supplied during each said modulation cycle provides a predetermined power to said valves to control the position of each said valve relative to said valve seat.

In a further aspect the invention consists in a flow control system comprising a first valve through which a first liquid is supplied and a second valve through which a second liquid is supplied both said valves being solenoid actuated valves each having a valve seat and a valve member controllably moveable from said valve seat by energisation of said solenoid by control means which control the supply of energy to each said valve using a pulse width modulation system in a modulation cycle having a constant modulation period wherein energy is supplied to said solenoid of said first valve for a first predetermined period of time and supplied to said second valve for a second predetermined period of time, said second period beginning after a predetermined elapsed period of time since the beginning of said first period, such that said elapsed period and said second period together are equal to said modulation period, the energy supplied during each said modulation cycle providing a predetermined power to each said solenoid to control the position of each said valve member relative to said valve seat.

In a further aspect the invention consists in a method of controlling the operation of a laundry machine having a first valve through which a first liquid having a high temperature level is supplied to said machine and a second valve through which a second liquid having a low temperature level is supplied to said machine, both said valves feeding into a mixing chamber having sensing means therein to sense the temperature of the mixed liquids in said mixing chamber and control means to control the quantities of said liquids in said mixing chamber to control the temperature of said mixed liquids substantially at a desired temperature using a pulse width modulation system, said mixing chamber having an outlet through which said mixed liquids at substantially said desired temperature flow into a washing container in said machine, said method comprising the steps of beginning a modulation cycle having a predetermined modulation period by supplying energy to said solenoid of said first valve for a first predetermined period of time, supplying energy to said solenoid of said second valve for a second predetermined period of time which period begins after a predetermined elapsed period of time since said first period began, said elapsed period and said second period together being equal to said modulation period, and repeating said modulation cycle, whereby the energy supplied during each said modulation cycle provides a predetermined power to each said valve to control the temperature of said mixed liquids in said mixing chamber.

In a still further aspect the invention consists in a laundry machine having a first valve through which a first liquid having a high temperature level is supplied to said machine and a second valve through which a second liquid having a low temperature level is supplied to said machine, both said valves feeding into a mixing chamber having sensing means therein to sense the temperature of the mixed liquids in said mixing chamber and control means to control the quantities of said liquids in said mixing chamber to control the temperature of said mixed liquids substantially at a desired temperature using a pulse width modulation system, said mixing chamber having an outlet through which said mixed liquids at substantially said desired temperature flow into a washing container in said machine said control means controlling the supply of energy to each said valve in a modulation cycle having a constant modulation period wherein energy is supplied to said solenoid of said first valve for a first predetermined period of time and supplied to said second valve for a second predetermined period of time, said second period beginning after a predetermined elapsed period of time since the beginning of said first period, said elapsed period and said second period together defining said modulation period, the energy supplied during each said modulation cycle providing a predetermined power to each said valve to control the temperature of said mixed liquids in said mixing chamber.

In a still further aspect the invention consists in a method of controlling a plurality of processes which may be in either an "off" state or an "on" state by pulse width modulation methods using a microprocessor having switching means to control said "off" state or said "on" state of each process and having only one timer, said method comprising the steps of, beginning a modulation cycle having a predetermined period by switching a first process to said "on" state with said switching means for a first predetermined period of time, measuring said first predetermined period of time with said timer, switching said first process to said "off" state with said switching means when said first predetermined period of time has elapsed, switching a second process to said "on" state for a second predetermined period of time, said second process being switched to said "on" state either before or after said first predetermined period of time has elapsed, measuring said second predetermined period of time with said timer, switching said second process to said "off" state with said switching means after said second predetermined time period has elapsed at which time said modulation cycle ends, and beginning another said modulation cycle.

This invention may also broadly be said to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

One preferred form of the invention will now be described with reference to the accompanying drawings wherein.

DETAILED DESCRIPTION

Figure 1:
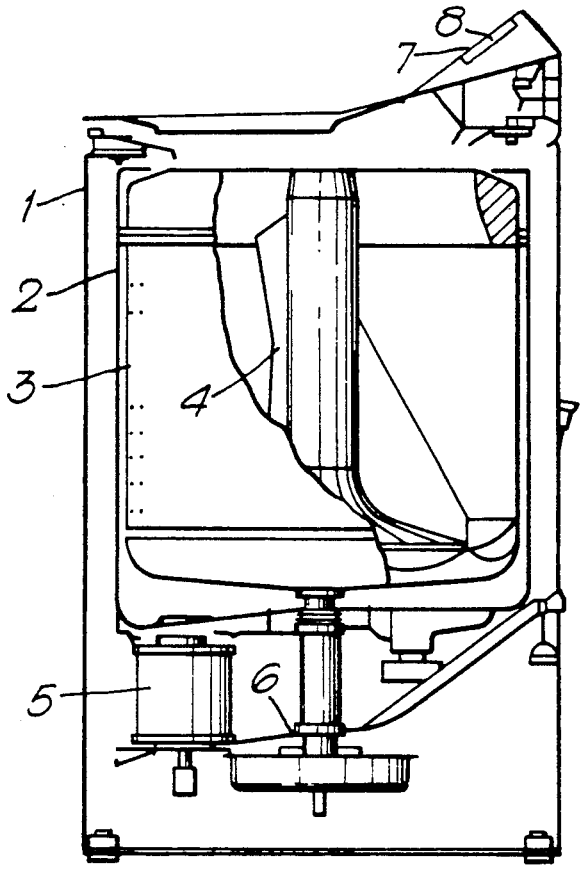
FIG. 1 is a schematic partial elevational and cross-sectional view; of a laundry machine incorporating the invention.

Referring now to the drawings, there is shown in FIG. 1 a laundry machine 1 having a container 2 in which a spin tub 3 and an agitator 4 are driven by an electric motor 5 through a belt (not shown) and a pulley 6. Such a construction is known. Mounted on the cabinet of the washing machine is a console control panel 7 which contains user control, including a microprocessor 8.

Figure 2:
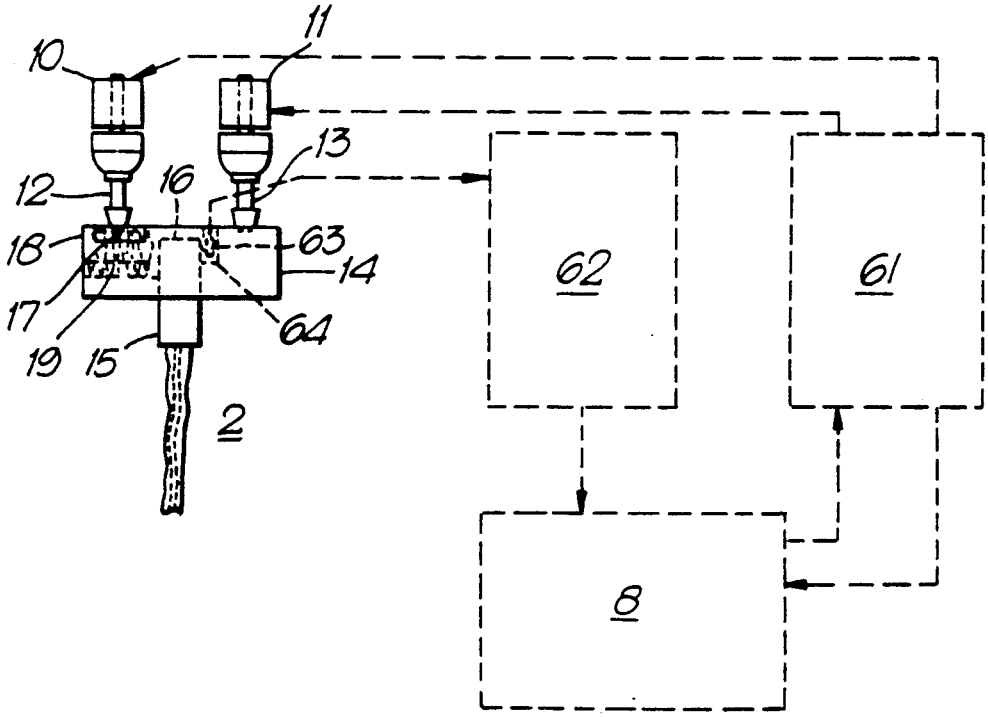
FIG. 2 is a diagrammatic drawing showing the arrangement of circuitry and valves forming part of the invention installed in the laundry machine of FIG. 1.

Referring now to FIG. 2, two electromagnetic solenoid operated valves are provided, a hot water valve 10 and a cold water valve 11 having inlets from a hot water supply and a cold water supply respectively and the outlets 12 and 13 from the valves lead to a mixing or mixed liquid e.g. water chamber 14. An outlet 15 having a weir type inlet 16 at an upper level of the mixing chamber 14 leads to the container 2 of the laundry machine. Mounted on the upper surface 17 of the chamber 14 is an assembly of electronic devices which heat up in use and such devices may comprise power switches such as I.G.T.'s, a high voltage IC rectifier and other control devices which in normal use are associated with an air cooled heat sink to dissipate heat which the devices generate in use. The chamber 14 is mounted in a container 18, the devices being embedded in a heat transfer material e.g. an epoxy resin and the container 18 is fixed to the surface 17 e.g. by the epoxy adhesive or by mechanical fixing including a heat transfer coating such as a heat transferring gel. The surface 19 of the container 18 is arranged to be below the level of the weir inlet 16 and is preferably corrugated or finned as shown to give an enlarged surface area exposed to water in the mixing chamber 14. The surface 19 is also preferably exposed to cold water flow from valve 11 before material mixing occurs.

Figure 3:
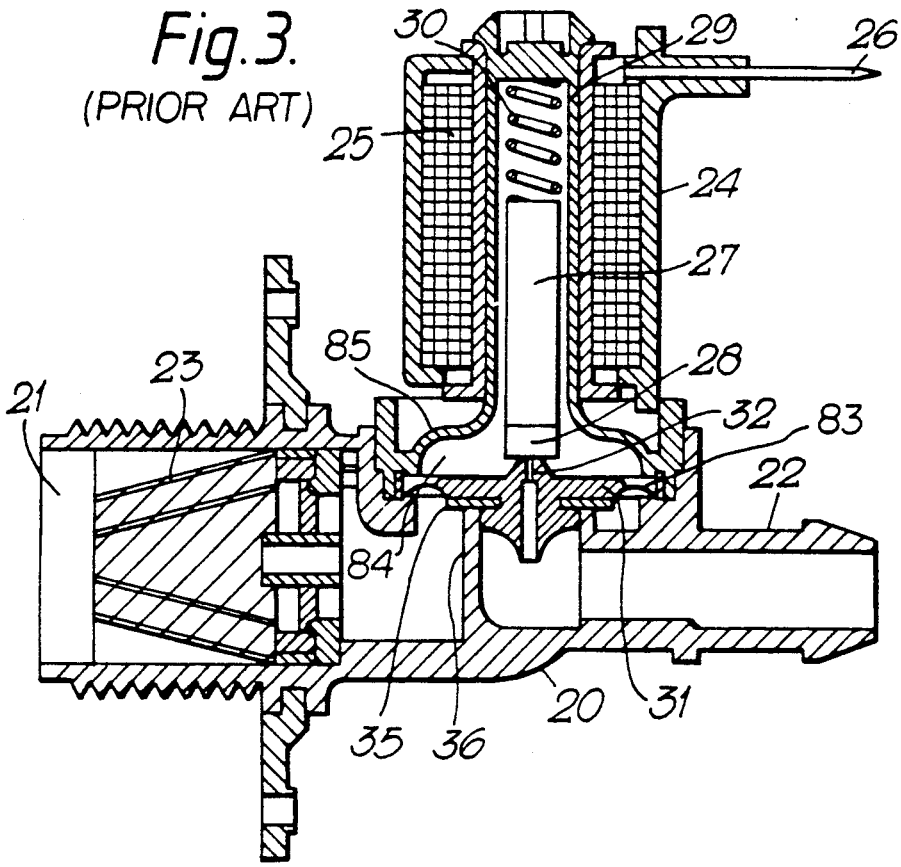
Fig.3. (PRIOR ART)
FIGS. 3 and 4 are cross-sectional views of valves forming parts of the invention.

One of the valves 10 and 11, e.g. the hot water valve 10 may be of the known form shown in FIG. 3, the valve comprising a body 20 having an inlet 21 and outlet 22 there being a filter 23 in the inlet 21. An electromagnet 24 has a solenoid coil 25 with a connection tab 26 and an armature or valve member 27 having a flexible seal 28 and running in an armature guide 29 being moved to a closed disposition by a spring 30. The rate of spring 30 is about 10N/m. The valve has a diaphragm 31 and a surrounding first flexible membrane 83 with a bleed hole 32 therein normally closed by the armature seal 28, but on energizing the coil 25 the seal is raised and the valve then admits water between the valve member seal 35 and the valve seat 36. A first damping chamber 84 is provided between the valve surround 85 and the diaphragm. The slow flow of liquid through the bleed hole 32 has the effect of damping or stabilizing the diaphragm and thus comprises flow control means. The damping or stabilizing effect is achieved since the water pressures on either side of the diaphragm over the areas on either side of the diaphragm will result in approximately equal forces on each side and thus control of the flow of liquid in the valve, stabilizing the diaphragm and valve member relative to the valve seat.

Figure 4:
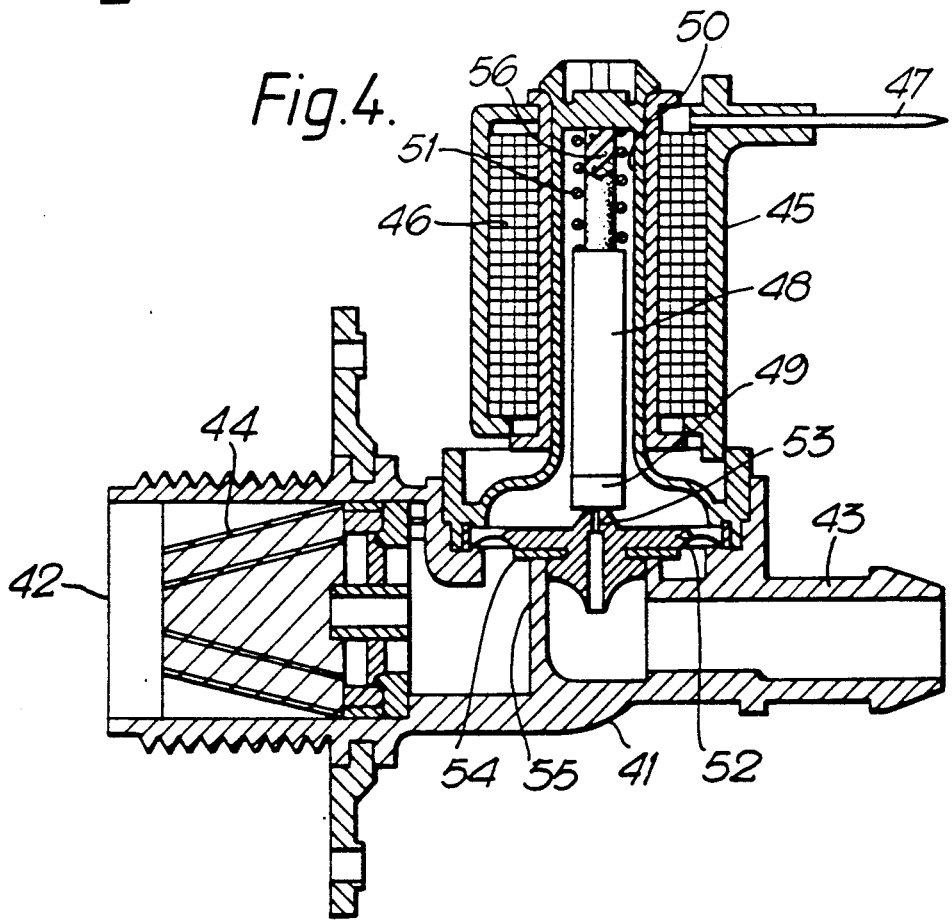

The other valve, i.e. the cold water valve 10 and preferably both valves, may be modified to provide proportional opening in accordance with FIG. 4, in which valve body 41 having an inlet 42 and an outlet 43, there being a filter 44 in the inlet 42. An electromagnet 45 has a solenoid coil 46 with a connection tab 47 and an armature or valve member 48 having a flexible seal 49 and running in an armature guide 50, being moved to a closed disposition by a coil spring 51. Enclosed within or surrounding the spring 51 are flow control means e.g. a damping means 56 comprising flexibly resilient sponge materials, e.g. in the shape of a cylinder. The rate of the spring 51 is up to about 1000N/m. The valve has a diaphragm 52 with a bleed hole 53 therein normally closed by the armature seal 49.

In operation the closed position of the valve is as shown in FIG. 4. When the solenoid coil 46 is energized the armature seal 49 is raised and the valve then admits water between the valve member seal 54 and the valve seat 55. Without the damping means 56 energization of the coil 46 causes the armature 48 to rise suddenly and/or oscillate and the momentum from the sudden acceleration of the armature 48 may cause the armature to rise further than a height which would result under equilibrium conditions. The restoring force provided by the spring 51 eventually brings the armature 48 to a standstill and causes the armature to accelerate in a downward direction before it is again stopped by either the valve seal 54 contacting the valve seat 55 or the effect of the energized coil 46 after which the armature may rise again, repeating the process. The tendency to oscillate is increased by the tendency of the water supply also to oscillate. These oscillations of both the armature and the water are undesirable and the damping means reduce or obviate the oscillations in use retarding the initial upper movement of the armature, thereby allowing a position to be reached under a damping control whereby the force exerted on the armature 48 by the energized coil 46 is opposed by a force of equal magnitude from the spring 51. A stabilizing influence is therefore given.

The degree of damping obtained will depend on the stiffness of the sponge material and on whether or not there is any initial compression thereof e.g. by making the sponge material of a wider diameter than the inner diameter of the spring and/or by providing spcnge material of greater length than the length of the spring 51.

Figure 10:
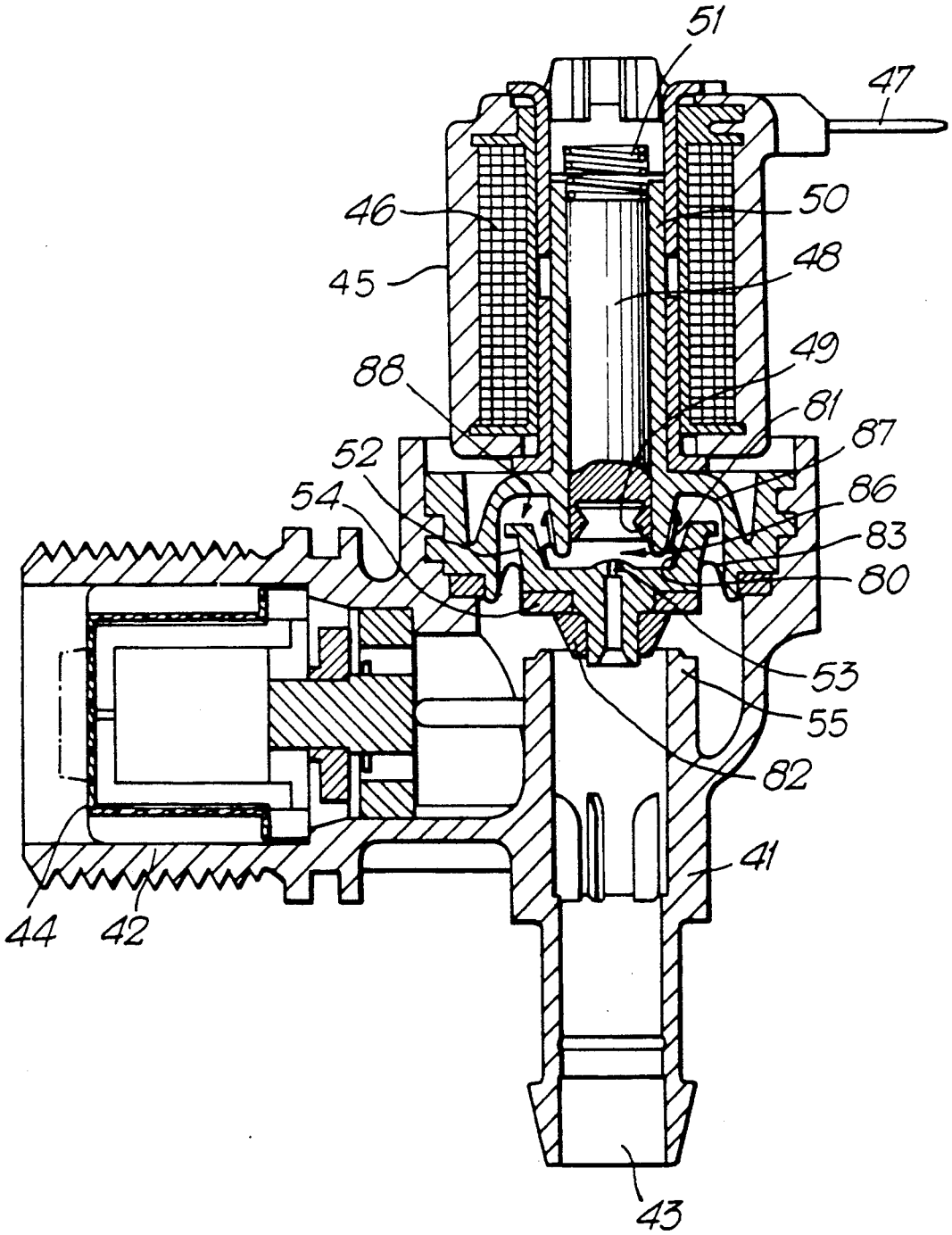
FIG. 10 is a cross-sectional view of a valve forming part of the invention.

Alternatively, the cold water valve 10 in FIG. 2 and preferably both valves, may be modified to provide proportional opening in accordance with FIG. 10, in which the valve body 41 has an inlet 42 and an outlet 43, there being a filter 44 in the inlet 42. An electromagnet 45 has a solenoid coil 46 with connection tabs 47 and an armature or valve member 48 having a flexible seal 49, the armature being disposed in an armature guide 50 and being moved to a closed disposition by a coil spring 51. The rate of the spring 51 is up to about 1000N/m. The valve has a diaphragm 52 and first flexible membrane 83 with a bleed hole 53 comprising a first restricted orifice therein normally closed by the armature seal 49. Region 86 between the diaphragm and valve surround 87 comprises a first damping chamber.

Operation is similar to the valve described in FIG. 4, except that further damping is provided by further flow control means comprising a second flexible membrane 80 which fits over the lip of armature guide 50 inside the upper or second damping chamber 88, in such a way as to restrict the water around the armature 48 within the armature guide 50. This membrane 80 is kept in place by a light spring 81. The membrane is manufactured as part of the rubber armature seal 49. This membrane has a small bleed hole comprising a second restricted orifice (not visible in the drawing, but located in the flexible part) which permits water to enter and leave the armature guide area at a slow rate, effectively acting as a damping device with the same effect as the sponge material 56 described in FIG. 4. Again the approximate equalization of forces on both sides of membrane 81 due to the water pressures over the area on each side of the membrane tend to stabilize the movement of the valve member relative to the diaphragm and therefore also tend to stabilize movement of the valve member relative to the valve seat.

The undesirable oscillations due to armature movement and water supply are damped by this water flow restriction, the effect of which can be regulated in manufacture by choice of the size of the bleed hole in the membrane 80.

When coil 46 is energized in order to change the position of armature 48 and therefore change the flow of liquid through the valve, the armature 48 may respond too slowly, due to water flow effects. This may reduce the efficiency of a control system used to control the flow of liquid through the valve. We have found that a much more rapid response may be achieved if a pulse of voltage higher than that required to maintain the armature 48 in a desired position is applied to coil 46, thus creating a greater change in the magnitude of the current in the coil 46 which increases the initial moving force applied to armature 48. The voltage applied to achieve the faster response may exceed the rated operating voltage of the coil 46, but being applied momentarily, is acceptable.

We have also found that when the energized coil has held the armature 48 in one position, response of the armature 48 to a change in coil energization may be slow due to friction between the armature 48 and the armature guide 50 and/or due to the flow of liquid through the valve. Response times may be improved significantly if the voltage applied to the coil is alternated or pulsed in such a way as to vary the current in the coil which appears to enable the valve to be moved more quickly from its average rest position.

It has also been found useful to modify the shape of the central hub of the valve seal 54 of the valve member in FIG. 10, namely conical part 82. This part provides stabilizing means and in the standard (non-proportional) valve is smaller and more rectangular in shape. By making the part a near fit inside the outlet tube 43, and by conferring on it a conical shape, stability of operation at low flow rates is improved. The flow of water between the valve seat 55 and valve seal 54 is at higher velocity than at other parts within the valve, and therefore at lower pressure. This effect tends to force the valve shut and acts as a destabilizing factor. By modifying the flow by employment of the conical shaped hub part 82 this effect is usefully and substantially reduced.

As referred to above preferably both valves 10 and 11 provide proportional opening and for example ELBI 12 volt DC proportional valves type NZ-068-LB88 may be used. These valves are generally of the construction shown in FIG. 10.

The control system for controlling the valves 10 and 11 comprises broadly a microprocessor (FIG. 2), being part of the microprocessor 8 of FIG. 1, proportional valve driver circuits 61, and a specified physical characteristic sensing circuit comprising in the preferred form, a temperature sensing circuit 62. The temperature sensing circuit is supplied with temperature signals from a thermistor 63 (FIG. 2) provided in a recess 64 which is below the level of the weir entry 16 to the outlet 15.

A preferred system according to the invention can be considered in four sections: (a) hardware; (b) valve control; (c) temperature sensing; and (d) microprocessor control and algorithm. The valves above described will perform the job required for the temperature controller herein described. There are however two additional requirements in the use of these valves. They are: 1. In order to achieve positional control and/or stability of valve member position we find it useful to modulate PWM pulses applied to the valves sufficiently and at a suitable frequency to minimise hysteresis. This hysteresis is caused by friction in moving parts and can cause loop instability or inaccuracy of result. The effect can be substantially removed or neutralized by low frequency modulation (between 10 Hz and 50 Hz) as is described further later. 2. Attention is given to the temperature limitations of the valve coils. For example if the coil has a 110° C. maximum coil temperature rise, but say that for best reliability not to exceed 95° C. In a laundry machine with no water flowing, 155° C. in a valve coil is reached in 15 minutes (12 V D.C. coil, 12 V Average applied, 20° C. ambient). If the machine requires 110 lt of water, a slow hot fill (say 5 lt/min) will require 22 minutes of valve operation and permissible valve operation time also depends on water temperature. Thus hot water duty cycles must be controlled to limit coil temperature rise to acceptable limits.

(a) Hardware

Figure 5:
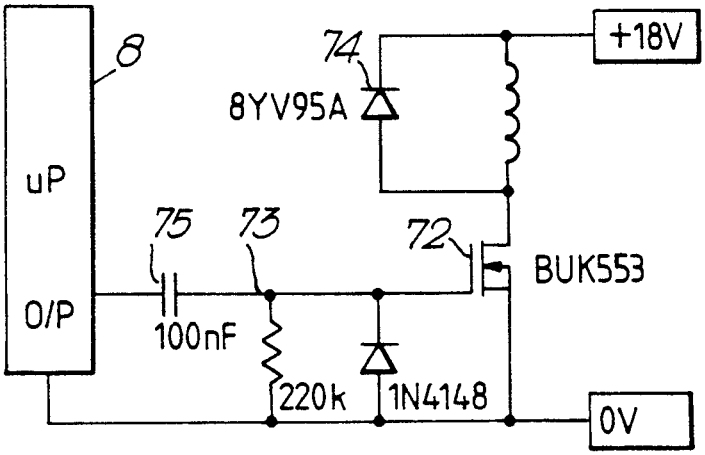
FIG. 5 is a partial controller circuit diagram for a valve according to the invention.

With reference to FIG. 5, it is to be noted that the valve solenoid coils 46 are each driven directly by the microprocessor 8, which provides software PWM internally. The valves are operated from approximately 16 V D.C. supply. The PWM period is set to suit the inductance of the coil (to minimise current ripple). This period (for 12 V coils) is about 1.5 ms. The duty cycle provided by the microprocessor controls the effective coil voltage.

The microprocessor provides a variable DC voltage by software pulse width modulation techniques. This DC voltage is applied to the valve driving MOSFET 72 via a DC restorer 73 (100 nF, 220k, 1N4148), the purpose of which is to ensure that the valve remains off if the microprocessor fails with its output statically on. When the microprocessor output is low (0 V) the capacitor discharges via a diode 74 and the FET 72 is off (gate at −0.6 V). When the output is high, the capacitor 75 charges via the micro output and the 220k resistor 76. The gate voltage rises to +4.4 V as a result of the charging current through the resistor. The time constant of this RC combination (22 ms) is sufficient to ensure that there is no significant droop in FET gate voltage during 500μs on time. If, however, the output remains high for greater than 22 ms the FET will start to turn off, protecting the valve coil and preventing a flood. It is believed that no separate flood protection circuit is required to protect against overfilling.

(b). Valve Control

The maximum duty cycle provided by the microprocessor is limited to about 75%. With this duty cycle the coil current is about the same as DC operation on 12 V. (The valve solenoids used are fitted with 12 V DC coils). To achieve this, the microprocessor provides three time intervals, called C, B and H(in FIG. 9). Only the COLD valve driver conducts during time C, BOTH conduct during time B and only the HOT valve driver conducts during time H. By restricting the minimum duration of interval C or H (i.e. restricting the maximum duration of B+H or B+C respectively) the maximum duty cycle of each valve is restricted. The intervals can be related mathematically:

$$C+B(1)+H=100\%\ PWM=1.5\text{ ms}$$

$C_{min}$ or $H_{min}=25\%$, so that the maximum duty cycle of either valve (C+B or H+B) is:

$$PWM_{max}=100\%-25\%+75\%.$$

Thus the microprocessor cannot provide greater than 12 V on the coil (16 V×75%=12 V). In the microprocessor, the three time intervals are achieved by setting an interrupt timer to one of three values defined by the temperature control algorithm.

The driver circuits for the hot and cold valves are identical. The physical arrangement of the water system is such that correct operation is possible with the hot water supplied to either one of the two valves. The software can test which valve is which during initialization, so flexible foolproof operation is possible. Only one timer is available in the microprocessor for operation of both valves, so the mathematics outlined above is complicated by the need to time PWM for two valves concurrently.

Figure 9:
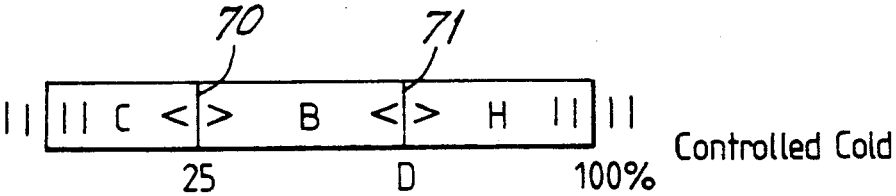

At any time during fill, one valve is fully on (usually the hot water valve since hot water is Often supplied at a lower pressure) to maximize fill rate, while the other is proportionally controlled. This fortunately means that the microprocessor only needs to provide controlled PWM one output at a time. The "uncontrolled" valve is maintained at 75% duty cycle. For example if the COLD valve is being proportionally controlled, the C interval in FIG. 9 is fixed at 25%, point 70. Point 71 moves in response to proportional control demand, which affects the PWM of the COLD valve, but not of the HOT valve. No additional timers are used, while the duty cycle of 75% for the "uncontrolled" valve is assured.

(c). Temperature Sensing

This section of warm fill control utilises a "D-A and comparator" type A-D converter. This converter uses successive approximation to bring its analogue output to (and to track with) the analogue input. This input is from a sensing means comprising a "unicurve" NTC thermistor mounted in the cooling chamber. The thermistor is mounted in such a way that it is in intimate contact with the fill water as it mixes just prior to entry to the wash tub. It has a sensing time constant of about 10 but preferably 4 seconds. Although the system operates satisfactorily with a thermistor having a time constant of 10 seconds, a 4 second time constant is preferable, since the lower the time constant of the thermistor the faster the overall response time of the control system. If the thermistor time constant is too long, problems may occur with sudden changes in water temperature. For example, there is often a volume of cold water residing in the hot water supply pipe of water supply systems of the supply has not been used for some time. When the hot water valve is turned on the cold water in the pipe will result in a low temperature sensed by the thermistor in the mixing chamber and the control system will demand more hot water to increase the temperature. When the hot water in the pipe finally does arrive at the machine (often 1 to 2 minutes later) it arrives suddenly, and before the thermistor and the control system have time to react, hot water pours on the clothes, and this may cause damage to the clothes. This problem has been remedied by decreasing the time constant of the thermistor (down to approximately 4 seconds) and increasing the speed of the control algorithm by increasing the speed of the integration. When there is no water in the cooling chamber, the sensor approaches the temperature of the cooling block through which it protrudes into the chamber. Thus it will eventually reach the block temperature in the event of failure of water supply (time constant about 10 minutes).

(d). Microprocessor Control and Algorithm

The washing machine display microprocessor handles a number of tasks, but the three to be described can be treated independently from other processes since they operate in an independent manner due to the nature of the microprocessor code structure and interrupt control. The three tasks are (1) Temperature Sensing; (2) Temperature Control Algorithm (PID Controller); and (3) Variable Overlap PWM Control.

1. Temperature sensing

Temperature sensing by successive approximation arrives at an output 8 bit word supplied to a D-A converter R-2R network which is the closest digital approximation to the current temperature dependent voltage at the thermistor. The R-2R network is provided with three resistors and the microprocessor 8. The 8 bit word is stored for use by the valve control algorithm (the CURRENT TEMP word).

The R-2R network is set by the three resistors to provide output voltages that correspond to thermistor resistances for the range −10° C. to 118° C. Since the thermistor circuit is nearly linear, this provides a resolution of 0.5° C. over this range (256 steps). Temperature sense absolute accuracy depends on the tolerances of several components (R-2R, resistors, thermistor) and can be compensated for in the set up procedure, where fill temperature offsets are programmed semi-permanently into EPROM.

2. Temperature Control Algorithm (PID Controller)

Temperature control is achieved by:

1. Sensing inflow water temperature with the thermistor fitted in the mixing chamber.
2. Measuring the thermistor resistance, calculating the thermistor temperature and calculating the temperature error.
3. Using the temperature error to control the voltage on the two valves which in turn effect the flow of hot and cold water.

During fill, the PID Controller task is given a number which equates to the desired or demanded fill temperature (the FINAL TEMP word). This temperature (a binary number in degrees Celcius) could be anywhere within the temperature sensor range, but for the fill to be accurate, it must lie between the hot and cold water supply temperatures. All fill temperature demands result in controlled fills unless outside the controllable range or control is overridden (cold fill). The PID controller also gets a MEASURED_TEMP word from the thermistor sensing software During fill the microprocessor PID control repeatedly calculates (from input information covered above) a valve demand value which is passed to the valve control software The calculation is based on a true PID (Proportional, Integral, Differential) control system. This technique overcomes the various shortcomings of feedback control using only one of the above methods.

The mixing chamber 14 may also be used to control the temperature of electronic switching devices used in the washing machine. For example, the transistors which control the current supplied to the motor windings in the washing machine may be mounted to be in thermal contact with the mixing chamber as described above with reference to FIG. 2. When the temperature of these devices rises significantly e.g. after a spin cycle in which the spin tub 3, agitator 4 and the clothes load have been spun by the motor 5 at high speed, the switching devices mounted on the mixing chamber may have reached a high temperature. These electronic switches need to be kept within a specific temperature range for efficient operation and one way of cooling these devices is to program the microprocessor to purge the mixing chamber with cold water when the thermistor senses a certain temperature in the empty mixing chamber. The mixing chamber only needs to be filled up to the level of the weir 16 with cold water and this water remains in the chamber until the next fill is required. Thus the purging process does not interfere with the wash cycle.

Using only proportional and integral control with low gains, we found that, performance can be stable and accurate but response time is poor, particularly at the start of fill where the warm water temperature increases suddenly (step response). Integral control provides a method of control which is dependent on the difference between the measured temperature and the demanded temperature when the difference is accumulated over time. To improve response a Differential term was added.

Differential terms are not simple to calculate, so a simple technique was used: as the integral error increased, the integral gain is changed (increased) to reduce the absolute error as quickly as possible and therefore to increase the responsiveness of the system. This is in effect a differential term. Thus the control is dependent on the rate of change of the temperature difference. This was implemented by making the integral term not incremental by ±1, but incremental by the total current error. (The bigger the error, the faster the integral term increments). To ensure that integer maths range was not exceeded a limit to the differential process was needed:

$\text{integral}_{13}\ \text{term}(t) = \text{integral_term}_{(t-1)} + k_2.\text{current_error}$ if $\text{integral_term} > k_3$ then $\text{integral_term} = k_3$ since $\text{control_term} = k_1.\text{current_error} + \text{integral_term}$ then $\text{control_term}_{(t)} = k_1.\text{current_error} + \text{integral_term}_{(t-1)} + k_2.\text{current_error}$ To satisfy the requirements of the PWM modulator software and to keep the signed arithmetic within range a constant offset term was added. The effect of this offset term $k_0$ is to define the starting point (i.e. the amount each valve is on when fill begins), and depends on the requested fill temperature. As it happens, the value chosen for $k_0$ gives a very suitable (and different) starting point for each fill temperature. The actual calculations performed are:

$\text{current_error} = \text{final_temp} - \text{measured_temp}$ at start:

$\text{integral_term}_{(0)} = 0$ and every $k_t$ milliseconds:

$\text{integral_term}_{(t)} = \text{integral_term}(t\text{-}1) + k_2.\text{current_error}$ if $\text{integral_term} > k_3$ then $\text{integral_term} = k_3$ $\text{control_term} = k_0 + k_1.\text{current_error} + \text{integral_term}$ At the start of each fill or when the demanded fill temperature (FINAL_TEMP) is changed, the integrated error term ($\text{INTEGRAL_TERM}_{(0)}$) is set to zero, preventing the system from potentially starting at an inappropriate point. When fill is paused no change is made to INTEGRAL_TERM. This allows fill to continue with minimum temperature disturbance. (There may be slight variation since the thermistor temperature can change due to cooling or water stratification while there is no flow).

3. Variable Overlap PWM Control.

The value CONTROL_TERM calculated by the PID control software is used by this routine to define the PWM modulation value (coil current) for both valves. The value is an 8 bit unsigned integer which gets larger as the temperature achieved falls behind (lower than) the demand. It either increases the HOT PWM or decreases the COLD PWM by a negative feedback process, to close the control loop.

Several methods of control were tried. The methods are covered briefly below:

(a) "Start with both on", where both valves are on at the start of each PWM cycle, and are turned off as necessary during the cycle, so that the cycle ends with both valves off. This method is flawed in that since only one timer interrupt is available, control accuracy is lost when the PWM value for the two valves is similar—they have to turn off at almost the same time (the timer can't be in two places at once and there is a minimum of about 4 microseconds interrupt processing time).

(b) "Non overlap", created to overcome the problems with the method above, is simple to implement. It turns one valve on at the start of the PWM cycle, then when it turns off the other is turned on, staying on until the end of the cycle. There is a problem with this method: it is not possible to get the sum of HOT PWM+COLD PWM to be greater than 100%. Typically either hot only, cold only or no water flows. The method would be quite suitable if higher (say 30 V) supplies were used.

(c) "Fixed overlap" control was designed about to overcome the problem highlighted in (b). This method added a fixed offset "ON" time to both valves, restricting the minimum PWM but increasing the maximum PWM. Unfortunately the problem of timing short intervals due to having only one timer reappeared, not now in the middle of the range, but at the two extremes.

Variable Overlap solves the above problems. There is no interrupt service overlap problem since it is at the extremes of the control range. Wide control range is available. It will be seen that this method may also be used to control more than two processes.

Figure 11:
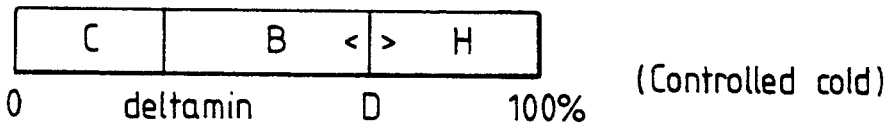
Figure 12:
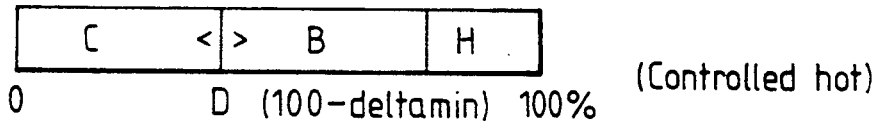

Referring to FIG. 11, first the COLD valve is operated, then after an elapsed period of time BOTH valves are operated, then just the HOT valve is perated for a second predetermined period of time. The cycle then repeats. The transitions to and from the BOTH interval are not both variable. The COLD-BOTH transition which occurs after the elapsed period of time is fixed at deltamin% for controlling the cold valve, while the BOTH-HOT transition varies from deltamin% to 100%. The reverse is true when controlling the hot valve as shown in FIG. 12.

There is a point where both valves are full on ((100-deltamin)%). For more COLD water, the HOT is controlled (i.e. to less deltamin) and vice versa. To maximise fill rate, one valve is always full on at (100-deltamin), while the other is the controlled valve. Note that deltamin is chosen to give the correct full-on voltage at (100-deltamin).

If the COLD only period is called C, BOTH is B and HOT is H, the following rules apply:

(a) Controlled cold (full hot)

C=deltamin%

H=100−(C+B)%

B=100−deltamin−H% control_term=(C+B)

Limits: control_term≧deltamin changeover to (b) at control_term>(100-deltamin)

(b) Controlled hot (full cold)

H=deltamin%

C=100−(H+B)%

B=100−deltamin−C%

Limits: control_term≧deltamin changeover to (a) at control_term>(100-deltamin)

Note that the CONTROL_TERM for the PID controller directly defines the PWM values. The absolute numbers used control the microprocessor timer in approximately 4 microsecond increments. A PWM period amounts to about 250×4 microseconds=1 ms, i.e. the PWM frequency is about 1 kHz.

The limitations of this method are as follows:

(a) The minimum PWM is 25%. In practice this is not a problem, since the valves will be off at 25%, plus the valve can be turned off completely as B approaches 75%.

(b) Timer overlap can happen, and does so when B approaches 75%, at either end of the controllable range. This is easy to test for (test B less than say 73%) and thus eliminate any timer errors.

(c) Minimum PWM will be related to design supply voltage. Within a small range, the lower PWM limit can be changed to suit different designed supply voltages; for example increasing minimum PWM to voltages; for example increasing minimum PWM to 33% will allow operation at 18 V with 12 V valves. This could just be accommodated with existing valves.

Advantages (a) Timer overlap occurs at the extreme ends of the controllable range.

(b) There is no practical limit on the performance of either valve.

(c) The point of maximum flow is now 75% (both fully on), just as with method 1.

(d) There are important advantages with respect to PWM modulation for hysteresis control.

Figure 6:
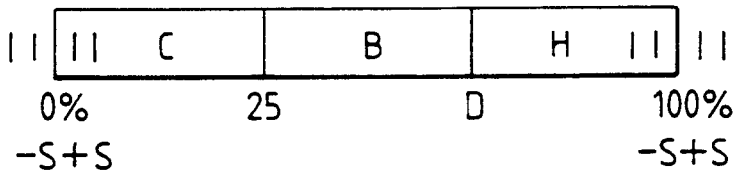
FIGS. 6 and 9 and 11 to 14 are diagrams of the preferred cycles of pulse width modulation used for the hot and cold water valves in accordance with the invention.
Figure 13:
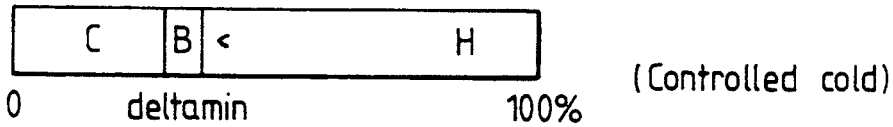
Figure 14:
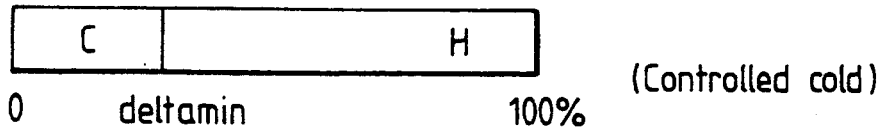

There are a number of complicating factors; (a) "critical time", (b) low frequency modulation, (c) supply voltage correction and (d) full on valve overheat prevention. (a).When the control system is at one or the other extreme of the control range, control is no longer possible. (For example the HOT valve is full on, the COLD valve is full off and still the controlled water is too cold). As it happens, just at this point the single timer interrupt problem recurs. By defining a minimum value for B called CRIT_TIME, this point can be sensed. When this point is reached (FIG. 13), the nearly off valve is turned fully off as shown in FIG. 14 (i.e. 0% rather than deltamin%). The timer interrupt overlap is avoided since (for controlled cold example) as B becomes<CRIT_TIME, C disappears to be replaced with an off period, followed by H, where H is maximum. B disappears, so one timer interval disappears completely:

H is now on for (100-deltamin)%, i.e. is fully on. (b).To improve control performance, the valves are vibrated at low frequency (about 20 Hz). This has the effect of overcoming striction which causes considerable hysteresis in the flow vs. current performance of the proportional valve. To achieve this modulation an extra vibration time period is added at the H-C interval i.e. at the 100%-0% point where one PWM cycle ends and the next begins and these extra time intervals are again referred to below with reference to FIG. 6. During this time interval a small amount of time (equivalent to say 20% of supply voltage) is added to C and subtracted from H or vice versa. The addition or subtraction process alternates at about 20 Hz. By adding the modulation at this point both valves are modulated by a fixed voltage so that the effect is most marked when the valves are just on (where it's needed most); it also neatly avoids the timer interrupt overlap problems it could introduce since at no time can H or C be less than or equal to the modulation value. (Typical values for deltamin being 25%).

(c).To ensure that the operating voltage on the valves (nominally 12 V coils operating on a 16 V supply) was optimum at the centre of the supply tolerance range (15.5 V), a fixed on time was added at the H-C transition to add a small amount to the effective supply voltage. This made a change to item (b) in that an added factor is added to the calculation:

$C = \text{deltamin}\% + a + (\pm s)$ $H = 100 - (C + B)\% + a - (\pm s)$ $B = 100 - \text{deltamin} - H\%$ where a is the voltage correcting increment and $\pm s$ is the modulating value ($\pm 20\%$). Note that s must be $<$-deltamin + a.

(d).Under normal circumstances the hot flow rate will be lower than the cold flow rate; thus the cold valve (in this case a proportional valve) will be controlled while the hot (on/off valve) will be fully on. Since the fill times may be very long (over 10 minutes), it is advantageous to reduce the coil heating if possible. As it happens the on/off valves have considerable hysteresis by design; typically a valve that pulls on 9 V will hold on 3 V. This is used to advantage.

Since there is no simple way with one timer to vary the PWM of the full on valve within one PWM cycle, the coil voltage is effectively reduced by leaving that valve off during one in three PWM cycles. The heating could be expected to reduce from (say) $V^2/R$ to $(2.V/3)^2/R$, a factor of $(2/3)^2 = 44\%$. In fact it is a little less than that due to current ripple. The inductance of the coil is too small (and the resistance too large) at frequencies below 1 kHz.

The normal C+B+H calculation continues, but the output driver overrides the valve ON instruction. There will be about 20% current ripple at 300 Hz ($\frac{1}{3}$ PWM frequency) due to the cycle skipping.

Some other considerations and PWM modulation as a means of temperature control are discussed in more detail under the three headings below.

1. The Over-Centre Flat Spot

There is a "flat spot" in the control system at the point where both valves are close to fully on. There is no way of knowing with the proposed control method when the valve flow has reached maximum, so the control algorithm continues ramping to maximum allowable PWM with little measureable flow rate change. When 75% PWM is reached the other valve is ramped down, and similarly little measureable change takes place for the first few steps. This effect may have a minor effect on fill accuracy if it happens that correct fill would be with both valves at the same voltage. (Not the same coil current or even the same flow —current and flow are at least dependent on coil resistance, coil temperature and water pressure). The presently proposed control system has tight control and fast response time and the "flat spot" has proved not to be a significant problem with this method of control.

2. Coil Temperature Considerations

For the highest reliability it is necessary to monitor water valve coil temperature, to ensure that it does not exceed the maximum allowable temperature. When using voltage control it is unlikely that catastrophic breakdown of the coil insulation will occur as the coil resistance will limit the coil temperature to about 110° C., provided water is flowing and the ambient temperature is not in excess of 20° C.

With a typical solenoid actuated valve used with the present invention, the maximum coil temperature is 115° C. (class F insulation), but for reliable operation it is preferable not to exceed 95° C. on a regular basis as degradation of the plastic coil moulding can cause moisture ingress and eventual insulation breakdown due to corrosion.

Coil temperature management is therefore desirable. Since direct measurement of coil temperature by coil resistance measurement is practical but too expensive, it is preferable to control temperature rise indirectly. The alternatives or goals are as follows:

(a) To limit the maximum on time of the hot valve at 75% PWM for 10 minutes.

(b) To limit the maximum on time of the cold valve at 75% PWM for 10 minutes.

(c) To limit operation without water to 5 minutes.

(d) To provide a cool-down time in the event of fill times exceeding 10 minutes.

(e) To introduce a MINIMUM FLOW RATE specification for hot and cold water in addition to the existing minimum and maximum pressure specifications of the current design, (1.0 to 10 bar and 5 lt/min) or suitable combinations of these.

(f) Where possible (if "non-proportional" valves are used for the HOT valve for example), the PWM of the fully on valve should be reduced once the valve is on, since this will reduce the coil heating. Where valves latch on at full flow, the coil current can be reduced by up to 50% with no significant reduction in flow.

Thermal cycling.

Figure 7:
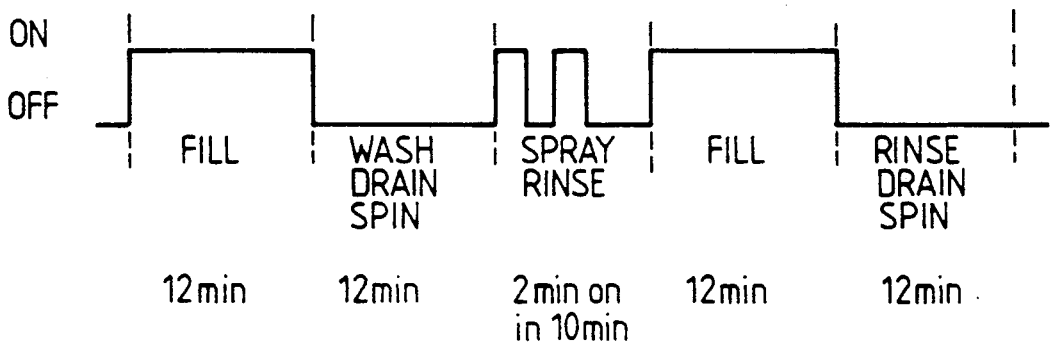
FIGS. 7 and 8 are respectively diagrams showing a cold valve duty cycle and hot valve duty cycle of a valve according to the invention in operation.
Figure 8:
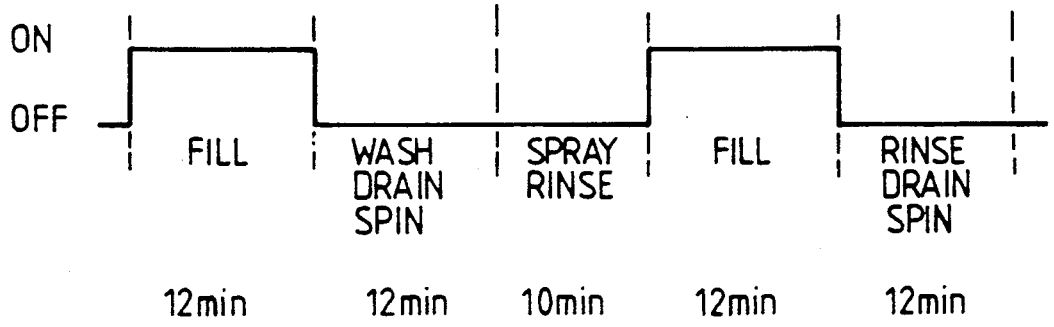

Referring to FIGS. 7 and 8, coil operation could be up to 12 minutes continuous operation with 12 minutes cool-down before a second 12 minute operation. The cold valve could operate three times within each wash cycle and the hot valve twice, as shown in the detail of duty cycle for each valve shown in FIGS. 7 and 8.

Close control of valve manufacture is necessary as a large dispersion in coil operating current for a particular flow can lead to unacceptable coil heating or poor flow performance. Software has been devised to cope with the dispersion found in manufactured valves.

To achieve these goals, the microprocessor "takes stock" of the fill situation continually during fill. For example if the fill proceeds too slowly a warning is sounded and fill stops. This can be caused by poor or no water supply or a water leak, but it also prevents valve coil overheating.

The microprocessor can differentiate between no hot water, no cold water, poor hot supply flow, poor cold supply flow, low hot water supply temperature, high cold water supply temperature, sensing thermistor failure, drain pump failure and water leakage, all of which can impede correct fill operation. It can do this since it can measure the instantaneous water level in the machine at all times (even during wash), the status of the pump motor and the status of the thermistor. The temperature control algorithm also produces alarms when its controllable range is exceeded.

The nature of the warning and action taken depends on the situation. For example if no cold water is available (cold tap off), a "serious problem" warning is announced and operation ceases. This prevents damage to clothing fabric and machine plastic parts caused by filing with only hot water. However, if no hot water is available, the "minor problem" warning is announced and after an interval operation continues as best it can. This can result in a less than optimum wash (cold instead of warm for example), but no damage will occur.

3. PWM modulation

It is well known that provision of a modulating force in addition to a steady force is an effective way of overcoming friction. If a force just sufficient to overcome moving friction is applied to a stationary object, it will not move until an additional starting "nudge" is applied to overcome static friction (e.g. sailors "heaving" on a sheet).

In electrical terms, it is also well known that use of AC supply to motors or solenoids considerably improves starting performance. Model railway locomotives are commonly supplied with half wave rectified DC at starting to improve smooth starting performance. These examples are all related to the difference between static and rolling friction.

Water valves have a moving armature controlled by a magnetic field and returned by a coil spring. The valve intended for proportional control as envisaged by the present invention has generally higher friction than a standard valve of the same type since it has extra components to provide damping and/or stabilizing of the armature movement. This friction has the effect of causing the transducer response to be markedly different depending on the direction of armature travel, herein referred to as the hysteresis effect.

To ensure accurate placement of the armature (and therefore accurate control of water flow), it is essential that the friction and hysteresis effects be overcome.

Early experiments with water valves in proportional applications showed that there were advantages in using a supply for controlled valves that contained considerable hum i.e. ripple voltage. The first practical microprocessor controller used by us demonstrated that even valves with very high hysteresis could be adequately controlled (in that case by applying phase controlled 50 Hz AC).

When the question of hysteresis effect elimination or control was considered in relation to the present project, it was quickly realised that the available power supply (16 V DC, regulated) could not in itself provide the necessary current ripple and therefore force modulation.

DEFINITION

PULSE WIDTH MODULATION of a solenoid

A higher supply voltage than necessary for DC operation is switched on and off the solenoid. Since the solenoid is inductive, the solenoid current will increase and decrease at a rate related to the inductance and the supply voltage:

$$di/dt = V/L$$

The required control current in the solenoid is maintained at an average value during the off time by use of a freewheeling or flyback diode. If the frequency of switching is sufficient there will be little current ripple in the solenoid. The average current which flows is directly related to the duty cycle of the switch. The duty cycle is generally quoted as a percentage:

$$\text{Duty cycle } \% = (\text{ON TIME}/(\text{OFF TIME} + \text{ON TIME})) \times 100\%$$

Since the current control in the valve electromagnet was to be by pulse width modulation, a small sideways step in logic suggested that ripple to overcome friction could be applied by modulating the PWM duty cycle. For example, if the duty cycle was to be 50% at any one moment, it would be set at (say) 60% for several cycles and (say) 40% for several cycles, so that the average was maintained at 50% but providing 20% current ripple, and importantly, 10% increase in peak ripple to overcome static friction. The frequency of ripple modulation can be tuned to the dynamic system of the valve armature.

This method of ripple modulation is not possible at approaching 100% duty cycle, (duty cycle cannot exceed 100%) but in this application the maximum static duty cycle is 75%, leaving plenty of room for ripple modulation. Similarly ripple modulation by the method outlined above is not practical at very low duty cycles. In this application there is no operation of the valve below 25% duty cycle anyway. The current ripple is most effective in the centre of the operating range where it is of most use.

The present invention therefore envisages this low frequency modulation of solenoid current by modulation of duty cycle as at least a desirable part thereof.

In one practical form of the invention, valves are Elbi type 319 proportional valves. The coil voltage is 12 V. The power supply is 16 V DC regulated +/−5%.

The valves are pulse width modulated (PWM), with the duty cycle C+B% (cold valve) and B+H% (hot valve), as outlined above. Ripple modulation is provided by delaying or advancing the end of each PWM cycle (and the corresponding start of the next PWM cycle, by an amount ±s in FIG. 6. The sign of s is alternated after many PWM cycles (typically 25 to 30), resulting in PWM modulation of 2.s % peak to peak (at typically 40 to 33 Hz).

As has been discussed above, modulation of the PWM value at some low frequency is an essential part of the control of hysteresis in the proportional water valve. This is achieved by position modulation of one or more of the transition edges in the timing diagrams of FIG. 9. Typically the variable edge 70 or 71 is modulated in position by adding a fixed time to the count before the transition and removing the same after the transition, then reversing the situation. This superimposes a low frequency square wave on the PWM DC current in the valve and causes a low frequency ripple in armature pulling force. (Other methods of control have a problem which relates to where the modulation is done. In these methods, the modulation is applied to the variable edge, and when this approaches within 10% (say for 10% PWM modulation) of the ends of range, the modulation will exacerbate the interrupt overlap problem, increasing it from about 5% to (say) 15%. This is unacceptable, and the historical solution has been to turn off the modulation as these limits are reached. The present control method has the desirable feature that the variable edge (transition) never approaches nearer the 0 or 100% points than 25% or 75%. Thus the 0 and 100% points (they are the same point) can be modulated by close to 25% without fear of timer overlap. This ensures that both valves are modulated, and what is more, they are modulated out of phase, causing little total low frequency power supply current ripple.

The rules for modulation are as follows (presuming controlled cold):

$C=25\%+S$ $B=75-H\%$ $Demand=(C+B)$

S (modulation level) $<25\%$.

From the foregoing it will be seen that the present invention provides both effective control of solenoid actuated proportional valves, and methods of PWM control of a plurality of processes by use of a microprocessor having one available timer. The invention is applicable to apparatus in which a mixture of two or more fluids having different physical characteristics is required. Such apparatus for example comprises refrigerators, freezers, dishwashers and air conditioners and the different characteristics may comprise for example colours, optical density and specific gravity.

What is claimed is:

1. A method of controlling a laundry machine having a first valve through which a first liquid having a high temperature level is supplied to said machine and a second valve through which a second liquid having a low temperature level is supplied to said machine, both said valves feeding into a mixing chamber having sensing means therein to sense the temperature of the liquid mixture in said mixing chamber and control means for controlling the quantities of said first and second liquids in said mixing chamber to control the temperature of said liquid mixture substantially at a desired temperature using a pulse width modulation system, said mixing chamber having an outlet through which said liquid mixture at substantially said desired temperature flows into a washing container in said machine, the method comprising:

beginning a modulation cycle having a predetermined modulation period by supplying energy to cause actuation of said first valve for a first predetermined period of time, supplying energy to cause actuation of said second valve for a second predetermined period of time commencing after a predetermined elapsed period of time from the beginning of said first predetermined period of time, said predetermined elapsed period of time and said second predetermined period of time together being equal to said predetermined modulation period; and repeating said modulation cycle, so that the energy supplied during each modulation cycle provides a predetermined power to each of said valves to control the temperature of said liquid mixture in said mixing chamber.

2. The method of controlling a laundry machine as claimed in claim 1 and further comprising:

making said first predetermined period of time exceed said predetermined elapsed period of time.

3. The method of controlling a laundry machine as claimed in claim 1 and further comprising:

varying said predetermined elapsed period of time; and maintaining said first predetermined period of time constant in separate modulation cycles to control said predetermined power to said valves.

4. The method of controlling a laundry machine as claimed in claim 1 and further comprising:

varying said first predetermined period of time; and maintaining said predetermined elapsed period of time constant in separate modulation cycles to control said predetermined power to said valves.

5. The method of controlling a laundry machine as claimed in claim 1 and further comprising:

adding a predetermined hysteresis time period to one of said first and second predetermined periods of time to improve the response of said valves to signals from said control means.

6. The method of controlling a laundry machine as claimed in claim 1 and further comprising:

controlling said predetermined power dependent on the difference between the temperature sensed by said sensing means and said desired temperature.

7. The method of controlling a laundry machine as claimed in claim 6 and further comprising:

controlling said predetermined power dependent on said differences accumulated over time.

8. The method of controlling a laundry machine as claimed in claim 6 and further comprising:

supplying said predetermined power in response to the rate at which said difference is increasing or decreasing over time so that the effectiveness of control of the position of said valve member relative to said valve seat provided by said control means increases or decreases as said difference increases or decreases.

9. The method of controlling a laundry machine as claimed in claim 1 and further comprising:

subtracting a predetermined hysteresis time period from one of said first and second predetermined periods of time to improve the response of said valves to signals from said control means.

10. A laundry machine comprising:

a first valve through which a first liquid having a high temperature level is supplied to said machine;

a second valve through which a second liquid having a low temperature level is supplied to said machine;

said valves having outlets feeding said liquids into a mixing chamber having sensing means therein to sense the temperature of the liquid mixture in said mixing chamber;

control means for controlling the quantities of said liquids in said mixing chamber to control the temperature of said liquid mixture substantially at a desired temperature using a pulse width modulation system;

a washing container; and an outlet for said mixing chamber through which said liquid mixture flows at substantially said desired temperature into said washing container;

said control means controlling a supply of energy to each of said valves in a modulation cycle having a constant modulation period wherein energy is supplied to actuate said first valve for a first predetermined period of time and energy is supplied to actuate said second valve for a second predetermined period of time, said second predetermined period of time beginning after a predetermined elapsed period of time from the beginning of said first predetermined period of time, said predetermined elapsed period of time and said second predetermined period of time together defining said modulation period, the energy supplied during each modulation cycle providing a predetermined level of power to each of said valves to control the temperature of said liquid mixture in said mixing chamber.

11. A laundry machine as claimed in claim 10 wherein:

said control means varies said predetermined level of power to each valve at regular time intervals to improve response of said valves to signals from said control means, 12. A laundry machine as claimed in claim 10 wherein:

said control means supply said predetermined power level to each valve to control the relative quantities of said liquids supplied by said valves in response to the difference between the temperature of said liquid mixture and said desired mixed temperature.

13. A laundry machine as claimed in claim 12 wherein:

said control means supply said predetermined power level to each valve in response to said difference accumulated over time.

14. A laundry machine as claimed in claim 12 wherein:

said control means supply said predetermined power level to each valve in response to the rate at which said difference is increasing or decreasing over time so that the effectiveness of control of said valves provided by said control means increases or decreases as said difference increases or decreases.

15. A laundry machine as claimed in claim 10 wherein:

said control means comprises a microprocessor and a switching device connected thereto for actuating said valves.

16. A laundry machine as claimed in claim 10 wherein:

each of said valves comprises a valve seat located between a valve inlet and a valve outlet, and a valve member controllably moveable between a closed position where said valve member engages said valve seat and an open position where said valve member is disengaged from said valve seat by said energy supplied to actuate each valve in response to said control means.

17. A laundry machine as claimed in claim 16 wherein:

said valves each comprise damping means to substantially reduce uncontrolled oscillation of said valve member relative to said valve seat.

18. A laundry machine as claimed in claim 16 wherein:

said valves each comprise position stabilizing means for stabilizing the position of said valve member with respect to said valve seat.

19. A laundry machine as claimed in claim 18 wherein:

said position stabilizing means comprise flow control means to control the flow of water around said valve member to stabilize said valve member.

20. A laundry machine as claimed in claim 19 wherein:

said flow control means comprise a first flexible membrane associated with said moveable valve member;

a first damping chamber defined by walls of a valve surround and part of said movable valve member;

and a first restricted orifice passing through said valve member between said first chamber and said liquid outlet.

21. A laundry machine as claimed in claim 20 wherein:

said flow control means further comprise a second flexible membrane associated with said moveable valve member;

a second damping chamber defined by a part of said moveable member, walls of a valve member guide, and said flexible membranes;

and a second restricted orifice passing through said second flexible membrane between said second damping chamber and said first damping chamber.

22. A laundry machine as claimed in claim 18 wherein:

said position stabilizing means comprises movement restriction means associated with a valve stem connected to said valve member to improve stability of said valve member at low rates of liquid flow through said valve.

* * * * *